United States Patent [19]

Gilbert

[11] Patent Number: 4,543,851

[45] Date of Patent: Oct. 1, 1985

[54] TORQUE APPLICATION ASSEMBLY FOR CLOSURE VALVE OF A RAILROAD HOPPER CAR OUTLET

[75] Inventor: Richard L. Gilbert, Foley, Mo.

[73] Assignee: ACF Industries, Incorporated, Earth City, Mo.

[21] Appl. No.: 391,328

[22] Filed: Jun. 23, 1982

[51] Int. Cl.[4] ..... G05G 5/16

[52] U.S. Cl. ..... 74/531

[58] Field of Search ..... 74/531; 222/516, 511; 251/214, 312; 267/162; 188/166, 83; 403/357, 146, 148

[56] References Cited

U.S. PATENT DOCUMENTS

| | | | |
|---|---|---|---|
| 2,006,896 | 7/1935 | Joyce | 74/531 X |
| 3,127,967 | 4/1964 | Fawkes | 74/531 X |
| 3,157,060 | 11/1964 | Marr | 74/531 X |
| 3,458,172 | 7/1969 | Burrows | 251/214 X |
| 3,550,472 | 12/1970 | Dummer | 74/531 |
| 3,987,687 | 10/1976 | Bland et al. | 74/531 |
| 4,018,104 | 4/1977 | Bland et al. | 74/531 |
| 4,041,796 | 8/1977 | Shishido | 74/531 |
| 4,114,785 | 9/1978 | Dugge | 251/305 X |
| 4,438,660 | 3/1984 | Kittle | 74/531 |

*Primary Examiner*—Gary L. Smith
*Assistant Examiner*—Rodney M. Lindsey
*Attorney, Agent, or Firm*—Polster, Polster and Lucchesi

[57] ABSTRACT

A torque application assembly is provided comprising an operating shaft having a non-round connection portion. At least one metal washer is connected to the non-round portion of the shaft so as to be rotatable therewith. A resilient spring engages the metal washer, and a barrel nut is provided to apply a compressive force to the spring under a desired compressive force thereby to apply a desired torque to the shaft without applying any substantially longitudinal force to the shaft. At least one low friction material washer is located between the metal washer and a fixed wall whereby the shaft and the metal washer can rotate with a minimum frictional drag with respect to the fixed wall.

6 Claims, 7 Drawing Figures

TORQUE APPLICATION ASSEMBLY FOR CLOSURE VALVE OF A RAILROAD HOPPER CAR OUTLET

BACKGROUND OF THE INVENTION

In the co-assigned U.S. Pat. No. 4,114,785 (1978) a pneumatic outlet is disclosed including a lading valve comprising a circular segment body portion and a moment portion extending outwardly from the body portion. The lading valve is movable between open and closed positions by an operating shaft having a pair of handles which are respectively located at either end of the outlet. The weight of the lading applies a moment to the body portion of the valve and thus tends to rotate the lading valve toward open position.

To prevent the lading from moving the lading valve to open position in transit, a preset torque is applied to the operating shaft by a Belleville spring held in engagement with a shoulder on the shaft by a threaded plug in a direction opposite to the diameter of rotation of the valve to open position. In this arrangement the threaded plug and Belleville spring apply a longitudinal force to the operating shaft which is reacted at the opposite end wall of the outlet. In this way the valve may be fixed in a desired partially open or metering position. The load on the operating shaft is transferred to the lading valve. In practice the amount of preload torque applied by the plug has varied due to varying tolerance limits between the valve and the end wall. In some instances the lading valve has been bent and in some instances the lading valve has been difficult or impossible to open.

SUMMARY OF THE INVENTION

The object of the invention is to provide an assembly for applying a preset torque to an operating shaft which is more consistent in applying a desired applied torque to the operating shaft. A torque application assembly is provided comprising an operating shaft or a non-round connection portion. At least one metal washer is rotatably connected to the non-round portion of the shaft such as to be rotatable therewith. A resilient spring engages the metal washer, and a suitable means is provided to apply a compressive force to the spring under a desired compressive force such as to apply a longitudinal force to the metal washer and a desired torque to the shaft. At least one low friction material washer is located between the metal washer and a fixed wall portion whereby the shaft and metal washer can rotate with a minimal friction drag with respect to the fixed wall portion.

In one embodiment, at least one Belleville washer is rotatably mounted on an operating shaft. A pair of metal washers are located on either side of the shaft such that the metal washers rotate with the shaft. Preferably a pair of washers made of low friction material are rotatably mounted on the shaft respectively on either side of the metal washers. Preferably the low friction material washers contain openings of sufficient size to allow the shaft to rotate relative to the low friction material washers. A third metal washer having an opening through which the shaft may rotate is provided which engages one low friction washer and a support wall. The other low friction washer engages a torque application means such as a barrel nut.

Preferably the operating shaft is provided with a non-round end portion and the Belleville washer includes a round opening surrounding the non-round end portion. Preferably the pair of metal washers also include cooperating non-round openings such that the metal washers turn with the shaft.

NYLATRON, a low friction material available from the Polymer Corporation in Reading, Pa., is the preferred low friction material.

IN THE DRAWINGS

DESCRIPTION OF PREFERRED EMBODIMENTS

Figure 3:
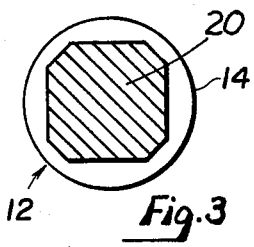
FIG. 3 is a sectional view looking in the direction of the arrows along the line 3—3 in FIG. 2.

The torque application assembly of the present invention is indicated in the drawings generally at 10. This torque application assembly comprises an operating shaft indicated generally at 12, including a round cross section portion 14 located inboard of a wall 16 and extending into an opening in the wall 18. The shaft 12 further includes a non-round portion 20 for example of square cross section illustrated in FIG. 3 and a threaded end portion 22. At least one and preferably a plurality of Belleville washers 24 having a round opening 26 are located upon the non-round shaft portion 20 and are held in place by a pair of metal washers 28 and 30 each having a non-round opening 32 having the same non-round configuration as the shaft 20. The metal washers 28 and 30 and the Belleville washers 24 thus rotate with the shaft as a unit.

A pair of low friction material washers 34 and 36 are respectively located outboard of the metal washers 30 and 28. The low friction material should have a low coefficient of friction with metal and at the same time be hard and durable to withstand the railway car environment. The coefficient of friction with metal is preferably not more than about 0.2. Hardness of the material is preferably at least about 120 (Rockwell R). The material should further have sufficient strength in compression to withstand the applied torque loads. Preferably the material should have at least a compressive strength of 12000 psi. A preferred material for the washers 34 and 36 is NYLATRON manufactured by the Polymer Corporation of Reading, Pa. A brochure is attached giving additional properties of this NYLATRON material.

Figure 1:
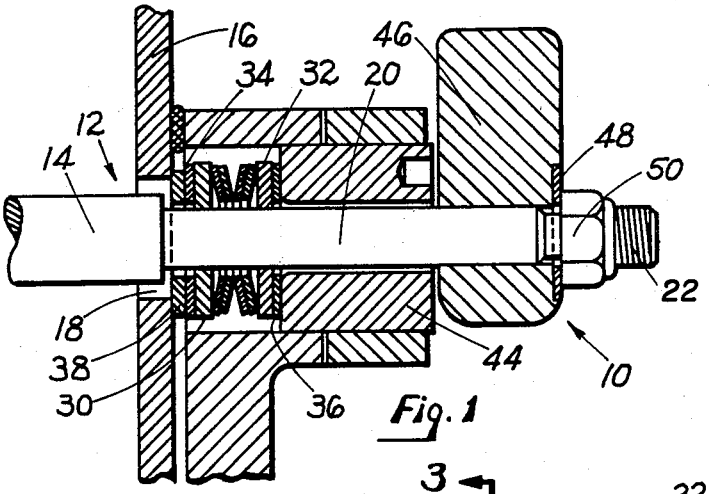
FIG. 1 is a vertical side elevation view of the torque application assembly of the present invention.
Figure 2:
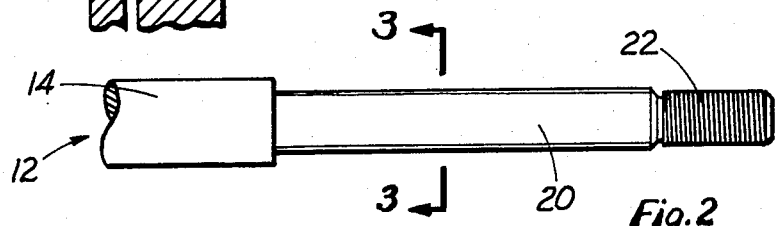
FIG. 2 is a detailed view of the end portion of the operating shaft used in the present invention.
Figure 4:
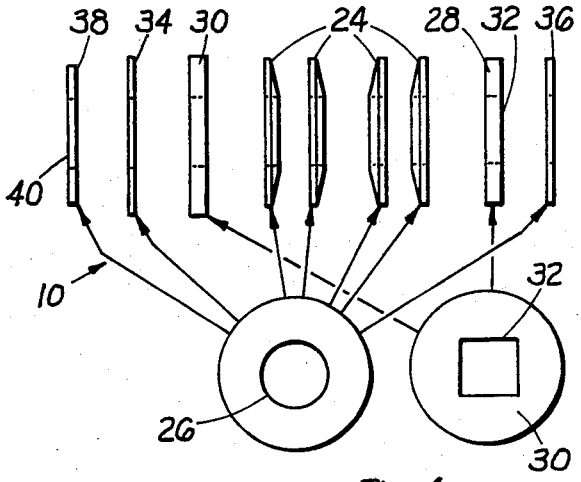
FIG. 4 is an exploded view of the torque application assembly of the present invention.

As shown in FIGS. 1 and 4, another metal washer 38 is located between the NYLATRON washer 34 and the wall 16. Metal washer 38 includes an opening 40 for the operating shaft. Also as shown in FIG. 1, metal washer 36 is in contact with a plug or barrel nut 44. An operating handle 46 for the shaft 12 is provided, and a conventional washer 48 and a threaded nut 50 located upon threaded end portion 22 holds the assembly together.

The torque application assembly 10 of the present invention is particularly adapted for use in connection with the outlet described in the aforementioned U.S. Pat. No. 4,114,785, which is hereby incorporated into the present application by this reference. Specifically, the assembly illustrated in FIG. 14 of the patent may be replaced with the assembly illustrated in FIGS. 1–4 of the present application. Preferably, both of the torque applicators 220 and 220′ (referring to the reference characters of U.S. Pat. No. 4,114,785) are replaced with the torque application assembly of the present invention.

Figure 5:
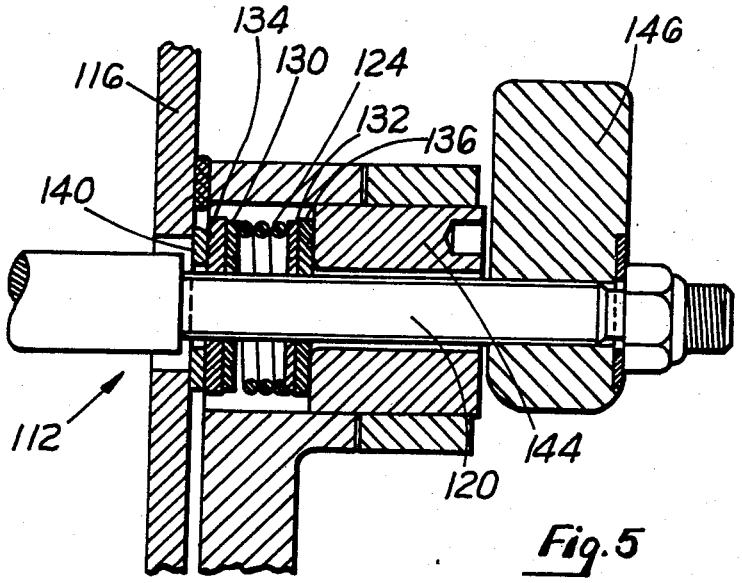
FIG. 5 is a vertical sectional view of another embodiment of the present invention illustrating a compression spring.

Another embodiment of the present invention is illustrated in FIG. 5. A compression spring 124 is located between a pair of metal washers 130 and 132 having square openings which turn with a square portion 120 of an operating shaft 112. NYLATRON washers 134 and 136 each having round openings are provided adjacent washers 130 and 132. The NYLATRON washers have a low coefficient of friction of not more than about 0.2 such that the NYLATRON washers can slip relative to the barrel nut 144 and relative to a plate 140 which engages a wall 116. Shaft 112 is turned by a handle 146.

This embodiment functions in the same way as illustrated in the embodiment in FIGS. 1–4. However, the embodiment in FIG. 5 illustrates that a different resilient means than Belleville washers may be utilized in the present invention.

Figure 6:
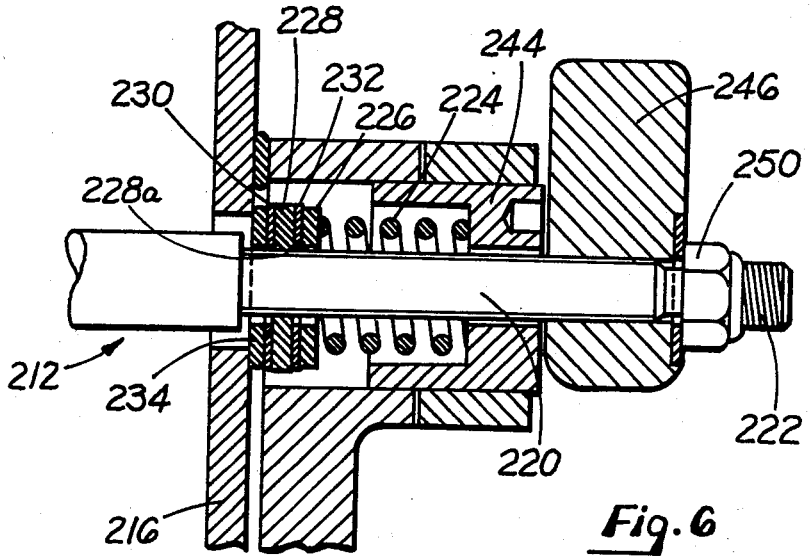
FIG. 6 is a view of another embodiment of the present invention utilizing a compression spring which is in direct contact with the barrel nut.

Still another embodiment is illustrated in FIG. 6. In this embodiment a spring 224 is located within a modified barrel nut 244 and engages a standard washer 226, having a round opening for the non-round shaft portion 220. A square center metal washer 228 is provided between a pair of NYLATRON washers 230 and 232. Washer 228 has a non-round opening **228*a* which corresponds to the non-round contour of shaft portion 220. NYLATRON washer 230 at its outer surface engages a standard metal washer 234 which engages wall 216. It is seen that with this embodiment, one metal washer is eliminated because the spring 224 directly engages the barrel nut 224. Operating handle 246 is used to rotate shaft 212. The operating handle is held in place with a threaded nut 250 which engages threaded shaft portion 222**.

Operating shafts 12, 112 and 212 conveniently extend longitudinally and engage lading valves.

Figure 7:
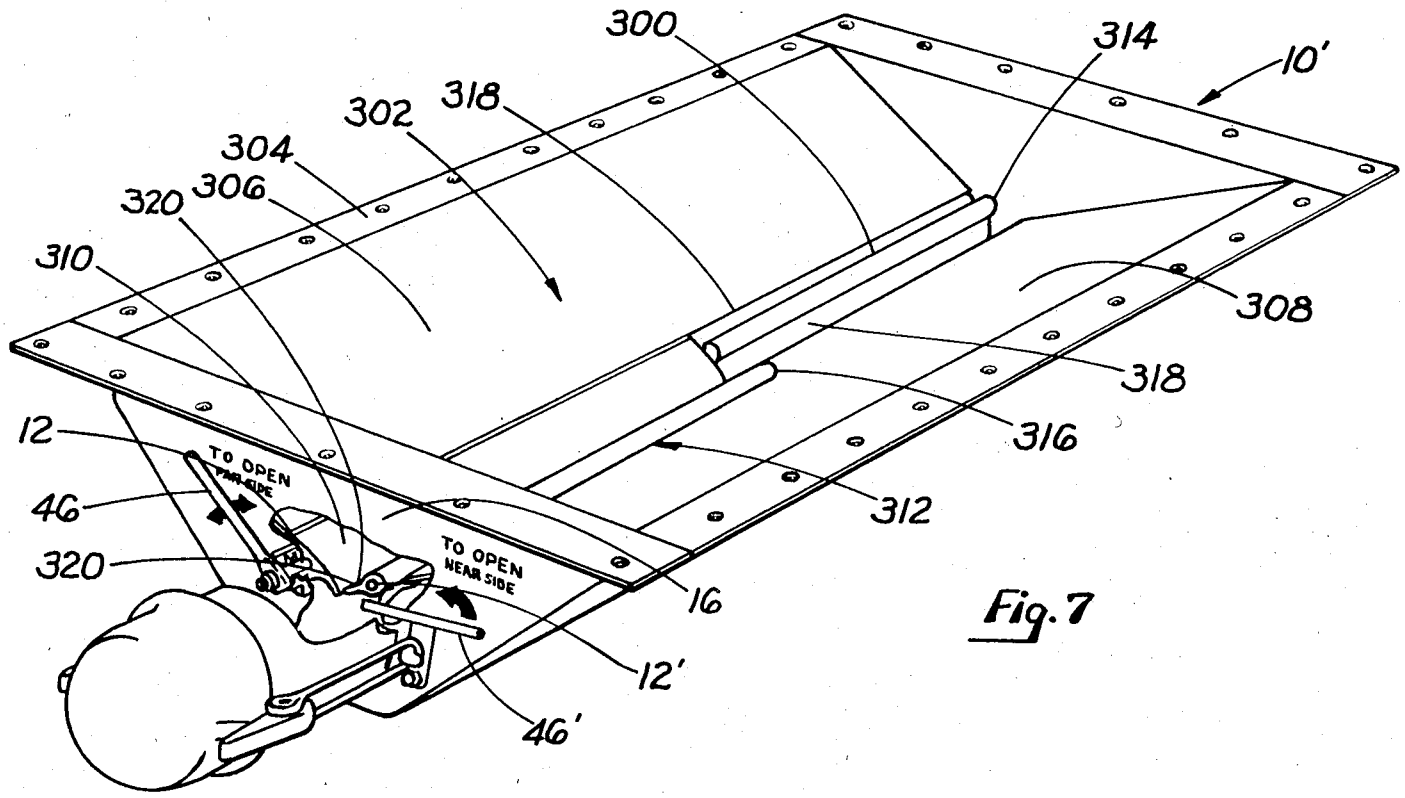
FIG. 7 is a view of an outlet utilizing the torque assembly of the present invention.

For example, as illustrated in FIG. 7, shaft 12 engages a lading valve 300 located within a pneumatic outlet 302 having a flange portion 304 and laterally spaced sloping hopper walls 306 and 308. Shaft 12 passes within a valve seat portion 310 which serves as a seat for a lading valve 312. An operating shaft 12′ is utilized to move the lading valve 312 between open and closed positions.

As described in greater detail in U.S. Pat. No. 4,114,785, lading valves 300 and 312 comprise respective body portions 314 and 316 and respective moment portions 318 and 320. Operating handles 46 and 46′ are provided for each of the shafts 12 and 12′. In addition, there are operating handles for the shafts 12 and 12′ at the other end of the outlet (not shown). Each of the shafts 12 and 12′ is provided with a torque application assembly 10 of the present invention. Preferably, the torque application assemblies 10 and another torque application assembly 10′ is provided at the opposite end of the outlet. However, if desired they may both be provided at the same end. Torque application assemblies 10 and 10′ apply a desired preset torque to the operating shafts while avoiding the transfer of a large longitudinal force down the shaft and to the operating valve. The valve members 300 and 312 operate in the same manner as described in U.S. Pat. No. 4,114,785.

What is claimed is:

1. A torque application assembly comprising: an operating shaft having a non-round connection portion; said shaft extending through a fixed wall; at least one metal washer spaced axially outwardly from said wall and being rotatably connected to said non-round portion of said shaft so as to be rotatable therewith; a resilient means engaging said metal washer; means for compressing said metal washer and said resilient means between said wall and said compressing means; at least one low friction washer located between said metal washer and said wall whereby a predetermined torque is required to rotate said operating shaft, wherein said resilient means engaging a second metal washer having an opening of sufficient size to allow rotation of said operating shaft.

2. In a control valve for a bottom discharge outlet of a railroad hopper car or the like, said outlet having a stationary wall, a rotatable operating shaft extending out beyond said wall, a rotary valve member movable between an open and a closed position by rotary movement of said shaft, and means for applying a torque to said shaft for holding said valve member in any desired rotary position, wherein the improvement comprises: said shaft having a non-round connection portion extending out beyond said wall; actuating means connected to said connection portion for movement of said shaft and said valve member between its opened and closed positions; an abutment member substantially surrounding said shaft but clear thereof and being engageable with said wall; means surrounding said shaft and being adjustably movable toward and away from said wall; and compressive, resilient means surrounding said shaft and being interposed between said abutment member and said means movable toward and away from said wall thereby to selectively compress or release said resilient, compressive means, said resilient, compressive means comprising at least one washer rotatably connected to and rotatable with said non-round portion of said shaft, a first low friction member surrounding said shaft and interposed between said abutment member and said one washer, spring means surrounding said shaft and interposed between said means movable toward and away from said wall and said one washer, and a second relatively low friction member surrounding said shaft and disposed between said spring means and said one washer such that relative sliding movement is prevented between said abutment member, said low friction members, and said one washer upon rotation of said shaft thereby to require the application of a predetermined torque to said shaft to cause rotation thereof without substantial application of axial force on said shaft.

3. In a control valve as set forth in claim 2 wherein said means movable toward and away from said wall is a nut separate from said shaft.

4. In a control valve as set forth in claim 3 wherein said spring means is a compression coil spring.

5. In a control valve as set forth in claim 3 wherein said spring means comprises at least one Belleville spring.

6. In a control valve as set forth in claim 2 wherein said abutment and said one washer are metal, and wherein said low friction members are of a suitable synthetic resin material, preferably having a coefficient of friction less than about 0.2.

* * * * *